US008863832B2

(12) United States Patent
Du et al.

(10) Patent No.: US 8,863,832 B2
(45) Date of Patent: Oct. 21, 2014

(54) ORIENTABLE ECCENTRIC DOWNHOLE ASSEMBLY

(75) Inventors: Michael Hui Du, Pearland, TX (US); Kevin Beveridge, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 276 days.

(21) Appl. No.: 12/892,289

(22) Filed: Sep. 28, 2010

(65) Prior Publication Data

US 2012/0073835 A1 Mar. 29, 2012

(51) Int. Cl.
*E21B 17/10* (2006.01)
*E21B 33/12* (2006.01)
*E21B 43/119* (2006.01)

(52) U.S. Cl.
CPC ..... *E21B 43/119* (2013.01); *E21B 17/10* (2013.01); *E21B 33/12* (2013.01)
USPC ..... 166/180; 166/189; 166/191

(58) Field of Classification Search
USPC ..... 166/180, 141, 189, 191, 313, 242.2; 175/325.7, 76
See application file for complete search history.

(56) References Cited

U.S. PATENT DOCUMENTS

| | | | | |
|---|---|---|---|---|
| 46,124 | A * | 1/1865 | Lyons | 166/189 |
| 2,605,637 | A * | 8/1952 | Rhoades | 73/152.55 |
| 2,829,190 | A * | 4/1958 | Comlossy, Jr. | 174/47 |
| 2,845,286 | A * | 7/1958 | Case et al. | 277/329 |
| 2,997,108 | A * | 8/1961 | Sievers et al. | 166/222 |
| 3,154,145 | A * | 10/1964 | Brown | 166/313 |
| 3,393,744 | A * | 7/1968 | Fagg et al. | 166/187 |
| 4,467,865 | A * | 8/1984 | Hardymon | 166/102 |
| 4,852,649 | A * | 8/1989 | Young | 166/189 |
| 4,945,995 | A * | 8/1990 | Tholance et al. | 166/375 |
| 6,082,455 | A | 7/2000 | Pringle et al. | |
| 6,761,222 | B2 * | 7/2004 | Wilson | 166/387 |
| 7,278,478 | B2 * | 10/2007 | LaClare et al. | 166/210 |
| 7,306,043 | B2 * | 12/2007 | Toekje et al. | 166/375 |
| 2002/0053438 | A1 * | 5/2002 | Williamson, Jr. | 166/373 |
| 2003/0079878 | A1 * | 5/2003 | Pramann et al. | 166/278 |
| 2004/0112590 | A1 | 6/2004 | LaClare et al. | |
| 2008/0311776 | A1 * | 12/2008 | Cox et al. | 439/192 |
| 2009/0250228 | A1 | 10/2009 | Loretz et al. | |
| 2010/0252279 | A1 * | 10/2010 | Buytaert et al. | 166/382 |

FOREIGN PATENT DOCUMENTS

| | | | | |
|---|---|---|---|---|
| EP | 651130 | A2 * | 3/1995 | E21B 33/127 |

OTHER PUBLICATIONS

International Search Report and Written Opinion of PCT Application No. PCT/US2011/050354 dated Apr. 9, 2012.

* cited by examiner

*Primary Examiner* — Kenneth L Thompson
(74) *Attorney, Agent, or Firm* — David J. Groesbeck; Brandon S. Clark

(57) ABSTRACT

An assembly employing multiple eccentric devices about a mandrel. The assembly is configured such that at least one of the eccentric devices is adjustably orientable relative another. Thus, for example, where the devices are packers disposed about completions tubing, the adjustable orientation may be utilized to ensure enough clearance is available for downhole advancement of the assembly. As such, the assembly may remain eccentric in nature without concern over damage during positioning, particularly to a communication line running to actuatable implements of equipment coupled to the completions assembly.

18 Claims, 5 Drawing Sheets

ORIENTABLE ECCENTRIC DOWNHOLE ASSEMBLY

FIELD

Embodiments described relate to downhole assemblies that are configured for eccentric positioning in a well. More specifically, assemblies that include multiple packers or other positioning devices at either side of jointed segments, for example, of production tubing. Such is often applicable in the circumstance of completion assemblies. However, embodiments detailed herein may be applicable to a host of other downhole assemblies which may utilize eccentric positioning.

BACKGROUND

Exploring, drilling and completing hydrocarbon and other wells are generally complicated, time consuming and ultimately very expensive endeavors. In recognition of the potentially enormous expense of well completion, added emphasis has been placed on well monitoring and maintenance throughout the life of the well. That is, placing added emphasis on increasing the life and productivity of a given well may help ensure that the well provides a healthy return on the significant investment involved in its completion. Thus, over the years, post-completion well diagnostics and treatment have become more sophisticated and critical facets of managing well operations.

Certain well maintenance applications involve the introduction of downhole equipment such as water jet devices, scale removal assemblies, packer placement equipment or any number of directly interventional implements. These may be delivered by pipe, coiled tubing, tractoring or other delivery systems and often involve closing off the well bore and ceasing production during the intervention. When accounting for the rig up and down time, application time, lost production, equipment and other costs, the expense of running such applications may exceed tens to hundreds of thousands of dollars.

In light of the expenses associated with direct interventions, where the opportunity arises, added emphasis has understandably been placed on well management techniques that are much less invasive. Completions assemblies in particular are often employed that include zonal isolation and flow control features that allow for modifying production over time in line with changing well conditions. So, for example, where one zone of the well becomes unproductive, say through the emergence of water, built in flow control sleeves or valves of the completions assembly may be utilized to close off fluid uptake from the zone. Thus, neighboring productive zones may be unaffected by the noted water production without the requirement of a post-completion intervention for the placement of plugs, packers or the like.

In order to actuate the noted flow control features of sliding sleeves or valves, the completions assembly is generally outfitted with a control line running from equipment at the oilfield surface. So, for example, the assembly may include tubing segments fitted to one another at a joint, each segment having a packer near the joint which accommodates the control line. Ultimately, with the assembly in place in the well, a relatively central located conduit of tubing is provided for hydrocarbon production. The internal conduit is left free of control line by utilizing packers about the tubing which include passages to accommodate the line and allow it to externally reach flow control features of the tubing segments.

In order to allow the control line to reach flow control features of the tubing from a location external to the tubing, the completions assembly may be of an eccentric configuration. That is, the tubing segments may be positioned slightly off of dead center relative the wellbore. This may be achieved by utilizing packers that, in a cross-sectional sense, have one side that is slightly fatter or wider than its opposite side. In this manner, the slightly wider side of the packers may have the space to be equipped with channels to accommodate the control line therethrough.

Aligning successive eccentric devices, such as the noted packers, may be particularly challenging. That is, with each packer affixed to a different tubing segment, proper alignment of say the wide sides of the packers at precisely the same stacked positioning about the joined tubings is dependent upon how the tubings are mated at the joint. For example, where the tubing segments are threadably joined, the alignment of the packers relative one another is dependent upon where they are positioned once the segments are fully threaded together. Of course, during design and manufacture of the packer equipped segments, they may be configured such that a completed coupling therebetween results in eccentric packers of roughly the same alignment or orientation.

Unfortunately, the degree of precision available in configuring tubing segments for oriented alignment of adjacent eccentric packers at either side of the coupling joint is less than desirable. This is not so much a matter of faulty precision as it is the severe space limitations afforded the completions assembly. For example, even with perfect alignment and the eccentric packers in an undeployed state, the amount of clearance between the assembly and the casing of the well is very minimal. Generally, this clearance is well under an inch. Thus, in circumstances where the packers are relatively close to one another, say less than about 10 feet or so, a misalignment of no more than a few degrees between the packers may result in an inability to advance the assembly within the well. That is, such a misalignment may eliminate the clearance altogether due to a lack of slack in the tubing, for example, were the packers to be separated by a greater distance.

Compounding the problem is the fact that such misalignment is often too small to be visibly detected and, even if apparent, the option of threadably loosening the joint for more proper orientation of the packers would be impractical and inadvisable. As such, operators are all too often left with the prospect of advancing the production assembly into the well in a relatively blind fashion, unsure of the prospect of the assembly reaching its targeted location, particularly without torque induced damage to the line.

SUMMARY

A downhole assembly is detailed with multiple eccentric devices adjacent one another and disposed about a common mandrel. More specifically, a downhole eccentric device is affixed to the mandrel at a downhole location. Further, an uphole eccentric device is positioned about the mandrel uphole of the downhole eccentric device and in an adjustably orientable manner.

DETAILED DESCRIPTION

Embodiments are described with reference to certain downhole completions assemblies. In particular, a downhole completions assembly as a platform for flow-controlled production is described that employs multiple eccentric packers. However, any number of multi-eccentric device assemblies may employ configurations and techniques as detailed herein. For example, an eccentric packer may be disposed adjacent an eccentric flow control valve. Indeed any assembly employing stacked multiple eccentric devices for accommodating an off-axis mandrel or tubular therethrough may make use of embodiments described below.

Figure 1:
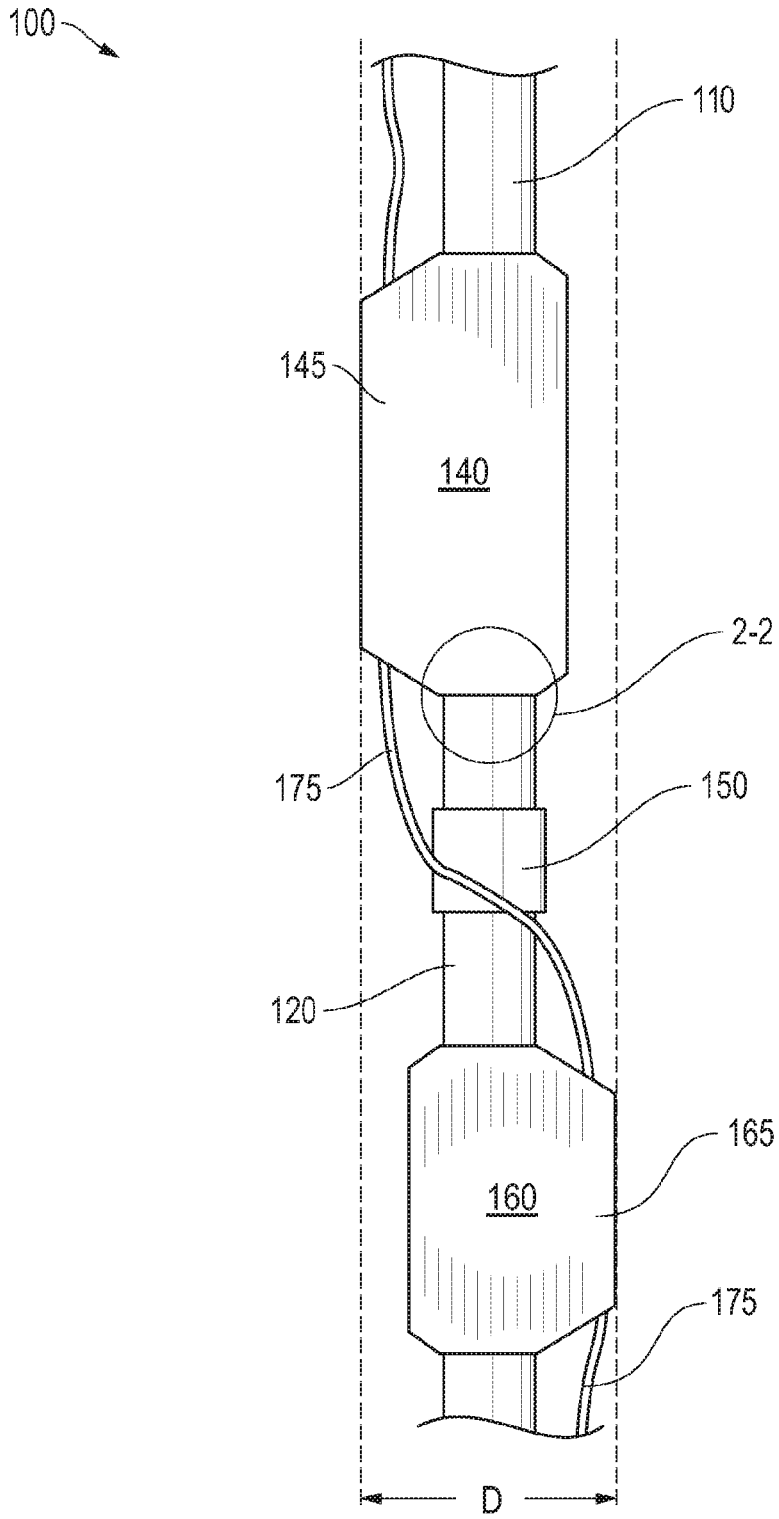
FIG. 1 is a side view of an embodiment of an orientable eccentric downhole assembly.

Referring now to FIG. 1, a side view of an embodiment of an orientable eccentric downhole assembly 100 is shown. The assembly 100 includes multiple eccentric devices in the form of packers 140, 160 about a central mandrel, in this case production tubing 110, 120. More specifically, the tubing may include uphole 110 and downhole 120 tubing segments that are threaded together in a conventional manner at the depicted joint 150. Once more, threading the segments 110, 120 together may bring the packers 140, 160 to within less than about 10 feet or so of one another. Thus, as detailed below, without a significant structural distance therebetween (i.e. for torque absorption), the orientation of one packer 140 relative another 160 may have a significant affect on the assembly 100 and its ability to advance through a conventionally sized well. This becomes apparent upon examination of the potential increased or maximum diameter (D) that is feasible with misalignment of the packers 140, 160 upon joining of the segments 110, 120.

As alluded to above and depicted in FIG. 1, fully threading the segments 110, 120 to one another may initially leave the eccentric packers 140, 160 secured thereto misaligned. That is, the extended bellies 145, 165 of the packers 140, 160 may be out of alignment relative to one another. Indeed, as shown in FIG. 1, a theoretically possible maximum misalignment of 180° is depicted. Nevertheless, as detailed below, embodiments of the assembly 100 allow for a re-alignment of the packers 140, 160 without loosening or otherwise affecting the fully threaded and sealed nature of the joint 150.

Figure 4:
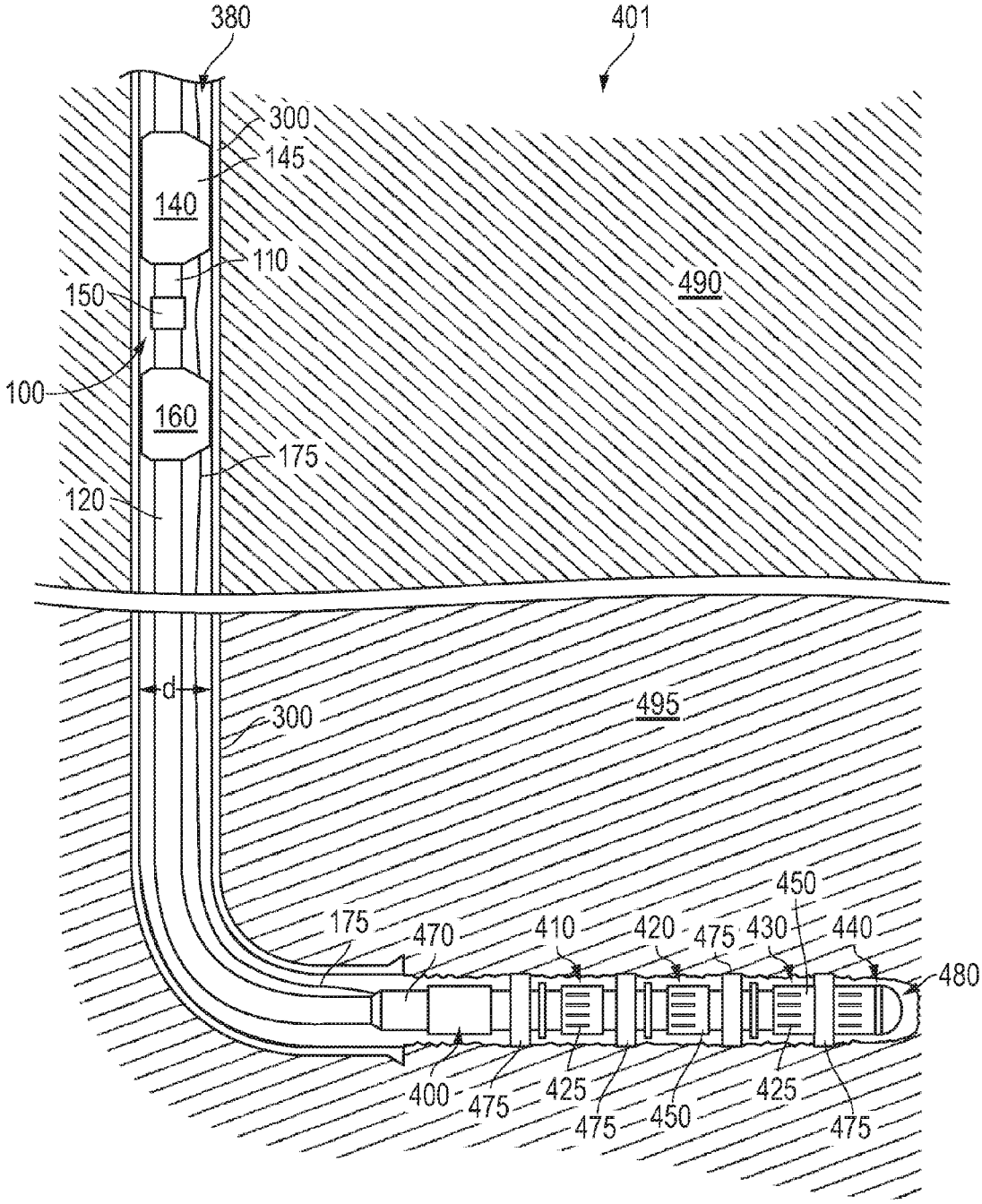
FIG. 4 is an overview of an oilfield with a well accommodating the aligned assembly of FIG. 3B therein.

Continuing with reference to FIG. 1, a control line 175 is shown traversing each of the packers 140, 160 as it runs from an oilfield surface to more downhole actuatable flow uptake equipment such as a production liner 400 (see FIG. 4). Thus, features such as sliding sleeves, valves and other downhole implements of such equipment may be controlled from the oilfield surface. The control line 175 may be electric, fiber optic or hydraulic in nature (or any combination thereof).

For sake of illustration, enough slack is provided in the control line 175 to allow for maximum misalignment of the packers 140, 160. However, in a more preferred embodiment, a lesser amount of slack may be provided. Regardless, with the maximum misalignment depicted, a maximum diameter (D), as measured from the surface of one belly 145 to another 165, is attained. This may add several inches to the profile of the assembly 100 as compared to a minimum diameter (d) with the bellies 145, 165 in alignment (see FIG. 3B).

With the minimum diameter (d) likely to be up to about 10 inches and a conventional well most likely less than about 12 inches in diameter, the possibility of the assembly 100 maintaining the maximum diameter (D) of FIG. 1 would be of concern. That is, advancement of such a large profiled assembly 100 through such a well of limited space may be impractical, particularly if damage to the assembly 100 and/or line 175 is to be avoided. While a maximum diameter (D) may be an unlikely occurrence, for example, due to lack of slack in the line 175, it is notable that in certain circumstances even 0.1 inches in misalignment as between the packers 140, 160 may render it impractical to advance the assembly 100 damage free into a well.

Fortunately, embodiments detailed herein allow for the re-alignment or re-orienting of the eccentric packers 140, 160 to allow for passive maintenance of the minimum diameter (d) as the assembly 100 advances through a well 380 (see FIG. 4). As noted above, this is achieved without sacrifice to the structural or sealing integrity of the joint 150. Rather, with reference to FIGS. 2A and 2B, embodiments of adjusting a position of at least one of the eccentric packers 140, 160 about the tubing 110, 120 so as to favor the minimum diameter (d) are depicted (see also FIGS. 3A and 3B).

Figure 2A:
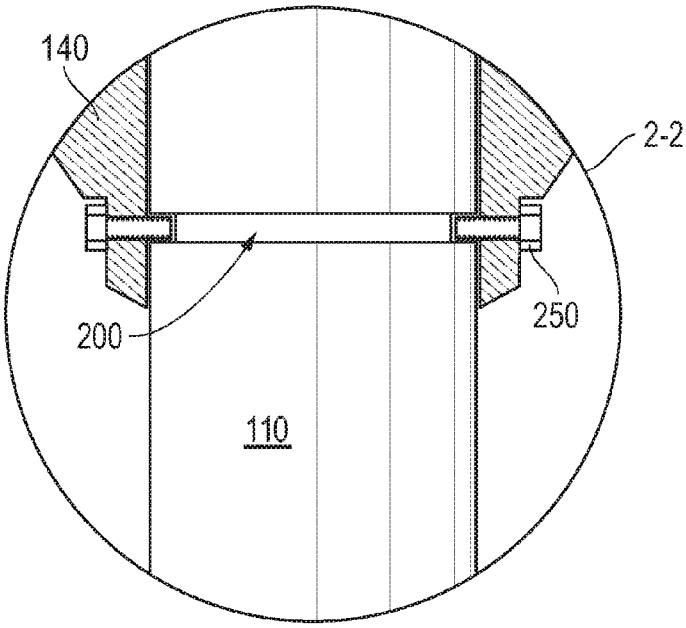
FIG. 2A is an enlarged view of FIG. 1 taken from 2-2 thereof and revealing one embodiment of adjusting a position of an orientable eccentric device of the assembly.

Referring specifically now to FIG. 2A an enlarged view taken from 2-2 of FIG. 1 is depicted. In this view an embodiment of adjusting a position of an orientable eccentric packer is shown. More specifically, the uphole packer 140 may be rotatably disposed about the uphole tubing segment 110 and defined recess 200 thereof. That is, the uphole packer 140 may be rotatably oriented into proper alignment with the downhole packer 160 of FIG. 1. Subsequently, securing elements such as pins or the depicted threaded screws 250 may be inserted through portions of the uphole packer 140 and into the tubing 110 at the recess 200 so as to hold the packer 140 in place. So, for example, with added reference to FIG. 1, the belly 145 of the uphole packer 140 may be rotated into alignment with the belly 165 of the downhole packer 160 and the screws 250 subsequently placed as described.

Figure 2B:
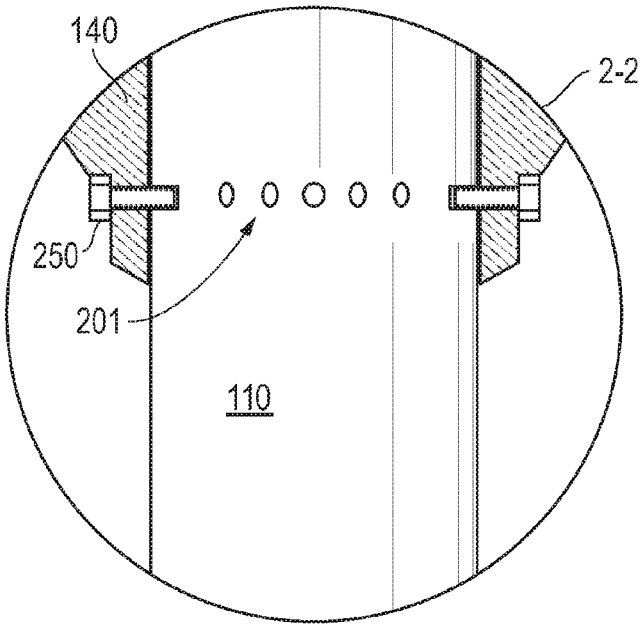
FIG. 2B is an enlarged view of FIG. 1 taken from 2-2 thereof and revealing an alternate embodiment of adjusting a position of the orientable eccentric device.

Referring now to FIG. 2B, another enlarged view taken from 2-2 of FIG. 1 is depicted. In this view an alternate embodiment of adjusting a position of the eccentric packer 140 is shown. Namely, a series of pre-formed threaded cavities 201 are provided for accommodation of the screws 250. Thus, as opposed to driving the screws 250 into the tubing structure defining the recess 200 as in FIG. 2A, the cavities may be pre-formed and positioned, perhaps ensuring an added degree of stability in receiving the screws 250. In the embodiment shown, the threaded cavities 201 are located at 30° intervals about the tubing 110. However, other intervals, such as at about every 15°, may also be effectively employed.

Figure 3A:
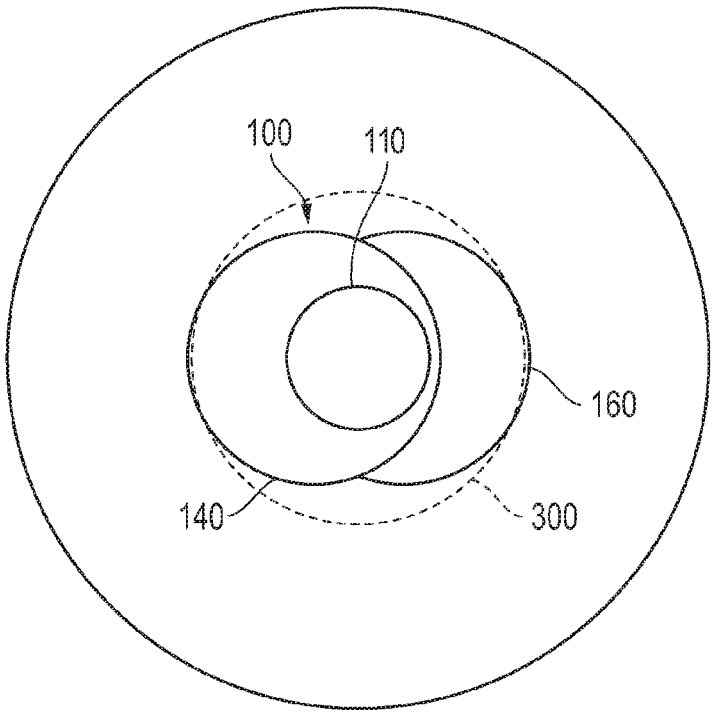
FIG. 3A is a top schematic view of the assembly of FIG. 1 with the orientable eccentric device misaligned relative another eccentric device.
Figure 3B:
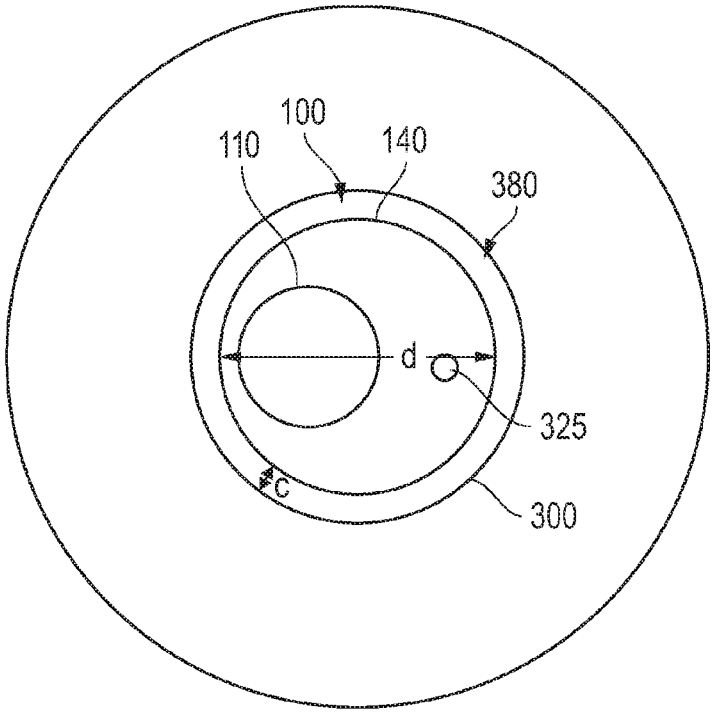
FIG. 3B is a top schematic view of the assembly of FIG. 3A with the orientable eccentric device adjusted into alignment with the other eccentric device.

Referring now to FIGS. 3A and 3B, top views of the assembly 100 of FIG. 1 are shown in schematic form. More specifically, FIG. 3A is a top schematic view with the orientable eccentric packer 140 misaligned relative the more downhole packer 160. In this top view, the misalignment is of the same manner as that depicted in the side view of FIG. 1. Alternatively, FIG. 3B reveals the orientable eccentric packer 140 adjustably positioned about the tubing 110 such that the packers 140, 160 are brought into alignment (see FIG. 3A).

Indeed, in FIG. 3B the view of the more downhole packer 160 of FIG. 3A is completely blocked by the aligned orientable packer 140 thereabove.

Continuing with reference to FIG. 3A, a well casing 300 is depicted in dashed lines. The casing 300 may define a 12 inch diameter well 380 such as that depicted in FIGS. 3B and 4. However, it is apparent in FIG. 3A, that the misalignment of the packers 140, 160 is of a greater degree than what would allow the assembly 100 to fit or advance within such a well 380. Indeed, the distance or diameter (D) occupied by the assembly 100 exceeds that of the casing 300.

Referring now to FIG. 3B, rotation of the orientable packer 140 about the tubing 110 into alignment over the downhole packer 160 of FIG. 3B is depicted. In this view, a channel 325 through the orientable packer 140 is depicted for accommodation of the control line 175 of FIG. 1. More notably however, is the presence of the assembly 100 within the well 380 (and its casing 300) which is now possible as a minimum diameter (d) of the assembly 100 is attained. In fact, an inch or two of clearance (c) is shown separating the assembly 100 and the well casing 300. Thus, placement of the assembly 100 within the well 380 may be readily achieved along with positioning of downhole equipment secured thereto.

Referring now to FIG. 4, an overview of an oilfield 401 is depicted with a well 380 traversing various formation layers 490, 495. The well 380 is defined by its casing 300 as noted above and accommodates the assembly 100 of FIG. 1 therein. However, as shown in FIG. 4, the assembly 100 is positioned at a fixed location in the well 380 with its packers 140, 160 set. That is to say, once the assembly 100 is advanced to its target destination as shown in FIG. 4, the packers 140, 160 may be expanded via conventional means for sealably anchoring the assembly. Thus, the diameter (d) of the appropriately aligned packers 140, 160 is increased to match the inner diameter of the well 380 as defined by the casing 300.

In the embodiment of FIG. 4, a production liner 400 is shown disposed at a coupling 470 at the end of the production tubing 120, which is in turn anchored by the assembly 100. More specifically, a production liner 400 is shown that is disposed in a lateral section 480 of the well 380 at a terminal end thereof. This section 480 of the well 380 is of an open-hole configuration as is often the case for such terminal regions. Further, production fluids from the corresponding formation layer 495 may be taken up by the liner 400.

Note that the liner 400 is equipped with a variety of production housings 450 each having a plurality of intake ports 425. Furthermore, the housings 450 are isolated from one another by several intervening isolation packers 475. Thus, each housing 450 may be viewed as dedicated to its own particular region 410, 420, 430, 440 of the section 480. As a result, internal flow control implements may be provided to selectively actuate or close-off production from each isolated region 410, 420, 430, 440. For example, where water is undesirably produced from the most terminal region 410, communications over the control line 175 may be employed to close an internal sliding sleeve of the housing 450 at this region 410. As detailed hereinabove, the eccentric nature of the assembly 100 allows for the safe reliable positioning and utilization of the control line 175 in this manner.

Figure 5:
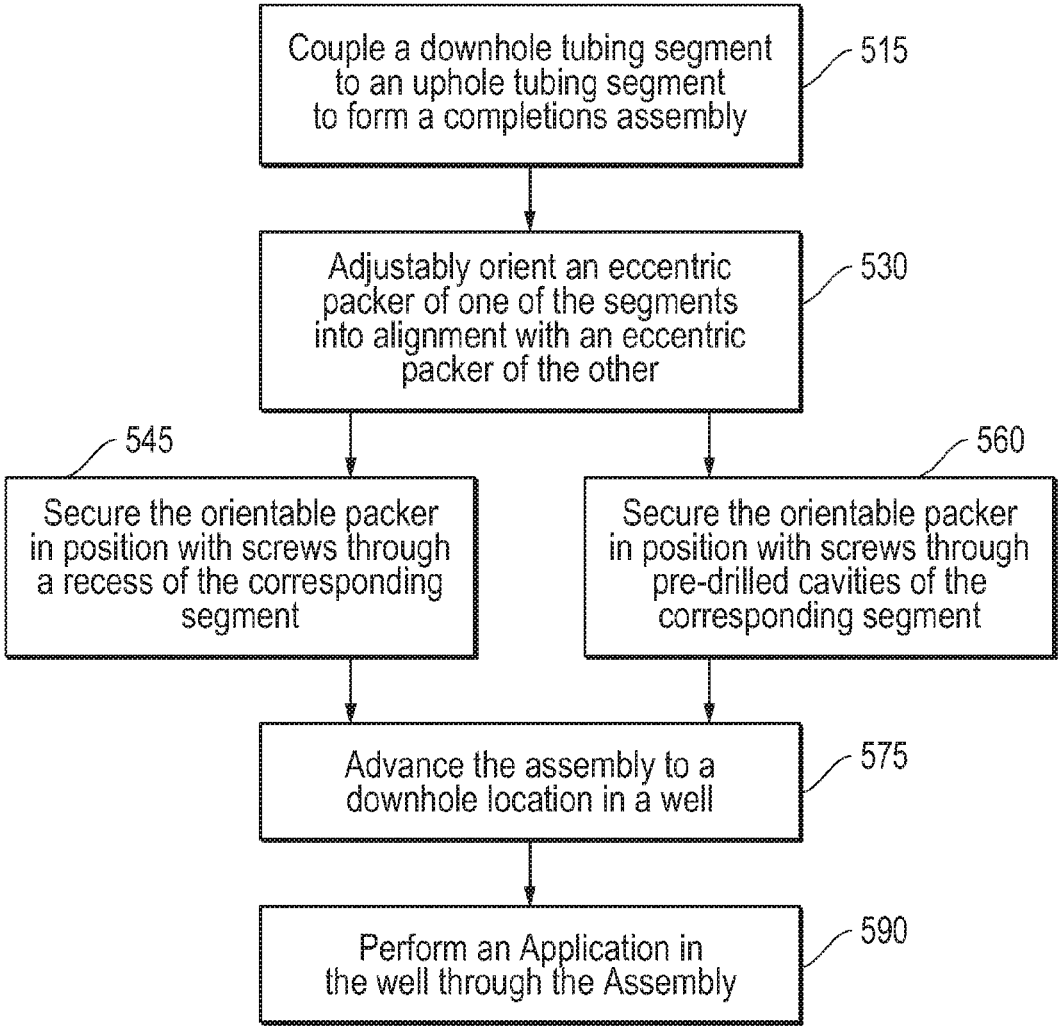
FIG. 5 is a flow-chart summarizing an embodiment of employing an orientable eccentric downhole completions assembly in an oilfield application.

Referring now to FIG. 5, a flow-chart summarizing an embodiment of employing an orientable eccentric downhole completions assembly is depicted. As indicated at 515, separate tubing segments may be coupled together. However, in other embodiments where tubing is not utilized, alternative forms of mandrel segments may be employed. Regardless, once joined, an eccentric packer or other device may be adjustably oriented about one of the segments and into alignment with an eccentric packer or device of the other segment (see 530).

Once alignment is attained, the orientable device may be secured in position with screws or other appropriate securing implements. This may be achieved by either advancing the screws through a recess of the corresponding segment as indicated at 545 or by advancement into pre-drilled/pre-formed cavities at predetermined locations about the corresponding segment (see 560).

With the assembly properly equipped with adjacent eccentric devices, it may be advanced downhole into a well. Due to the ensured alignment of the devices, advancement into the well may not only proceed as indicated at 575, but may proceed without undue concern over damage to the assembly or a control line thereof. Thus, as indicated at 590, an application may be reliably performed in the well through the assembly.

Embodiments detailed hereinabove compensate for challenges associated with the lack of precision that might otherwise be expected where the alignment of adjacent eccentric devices is dependent upon the threaded coupling of a mandrel segments therebetween. Thus, concern over space limitations afforded by completions assemblies employing such devices in the form of eccentric packers may be kept to a minimum. Indeed, enhanced alignment of adjacent packers on such assemblies may be realized through embodiments described herein, along with increased clearance for safe assembly advancement in a well. Furthermore, this may be achieved without need for compromise of the structural soundness or sealing nature of the joint coupling the tubing or other mandrel segments. Indeed, the need for this joint to take the form of a cost prohibitive and time consuming swivel variation is also eliminated.

The preceding description has been presented with reference to presently preferred embodiments. However, other embodiments not detailed hereinabove may be employed. Persons skilled in the art and technology to which these embodiments pertain will appreciate that still other alterations and changes in the described structures and methods of operation may be practiced without meaningfully departing from the principle and scope of these embodiments. For example, more than two eccentric devices may be employed on the assembly and more than one of such devices may be orientable. Indeed, in one embodiment, three eccentric devices may be disposed along the mandrel or tubing over less than about 40 feet. Furthermore, the foregoing description should not be read as pertaining only to the precise structures described and shown in the accompanying drawings, but rather should be read as consistent with and as support for the following claims, which are to have their fullest and fairest scope.

We claim:

1. An eccentric zonal isolation completions assembly comprising:

a mandrel to accommodate hydrocarbon production therethrough;

a first eccentric isolation packer affixed about a first segment of the mandrel in an off-axis manner;

a second eccentric isolation packer adjustably angularly orientable about a second segment of the mandrel in an off-axis manner and coupled to the first segment, wherein the first and second eccentric isolation packers can be oriented with their respective eccentricities out of alignment with one another to achieve a maximum overall diameter and into alignment with one another to achieve a minimum overall diameter; and a control line disposed through the packers for regulation of the production;

wherein the mandrel is positioned within a tubing string with the mandrel centered within the tubing string, and wherein the eccentric isolation packers are angularly orientable about the mandrel about an axis aligned with the center of the tubing string.

2. The assembly of claim 1 wherein the orientable second eccentric isolation packer is positioned uphole of the first eccentric isolation packer about the mandrel.

3. The assembly of claim 1 further comprising a flow control valve secured at the mandrel.

4. The assembly of claim 1 wherein the eccentric isolation packers are within less than about ten feet of one another about the mandrel.

5. The assembly of claim 1, wherein the first eccentric isolation packer is adjustably angularly orientable about the first segment of the mandrel.

6. The assembly of claim 1, wherein the first segment of the mandrel is coupled to the second segment of the mandrel at a threaded joint.

7. A method of performing a zonal hydrocarbon production application at a location in a well, the method comprising:

coupling a downhole tubing segment to an uphole tubing segment to form a completions assembly for accommodation of the application therethrough;

adjustably angularly orienting a first off-axis eccentric packer of one of the tubing segments with a second off-axis eccentric packer of the other tubing segment, wherein each of the packers has an eccentricity, wherein angularly orienting the eccentricities out of alignment with one another increases the overall diameter and orienting the eccentricities into alignment with one another reduces the overall diameter;

advancing the assembly to the location; and employing a control line disposed through the packers for regulation of the application.

8. The method of claim 7 further comprising expanding the packers for anchoring the assembly at the location.

9. The method of claim 7 further comprising securing the orientable packer in position prior to said advancing.

10. The method of claim 9 wherein the securing comprises holding the orientable packer in place with securing elements into the corresponding segment.

11. An oilfield assembly comprising:

a tubing;

eccentric devices disposed about the tubing in an off-axis manner, at least one of the eccentric devices adjustably orientable relative said tubing for alignment with another of the eccentric devices, wherein orienting the eccentric devices into and out of alignment with one another decreases and increases, respectively, the overall diameter of the assembly;

at least one sliding sleeve coupled to the tubing for an application therethrough; and a communication line disposed through the eccentric devices and to the at least one sliding sleeve.

12. The assembly of claim 11, wherein the eccentric devices comprise two eccentric devices.

13. The assembly of claim 11, wherein the eccentric devices comprises more than two eccentric devices.

14. The assembly of claim 11, wherein the eccentric devices are packers.

15. A completion assembly, the completion assembly comprising:

a tubing having an axis;

eccentric devices disposed about the tubing in an off-axis manner, at least one of the eccentric devices adjustably orientable relative to the tubing axis for alignment with another of the eccentric devices, wherein orienting the eccentric devices into and out of axial alignment-with one another decreases and increases, respectively, the overall diameter of the assembly;

a flow control device coupled to the tubing; and a communication line disposed through the eccentric devices and to the flow control device.

16. The completion assembly of claim 15, wherein at least one of the eccentric devices is a packer.

17. The completion assembly of claim 15, wherein the eccentric devices comprise two eccentric devices.

18. The completion assembly of claim 15, wherein the eccentric devices comprise more than two eccentric devices.

* * * * *